US006259868B1

(12) United States Patent
Fujii et al.

(10) Patent No.: US 6,259,868 B1
(45) Date of Patent: Jul. 10, 2001

(54) IMAGE FORMING APPARATUS WITH WIDTH DETECTION

(75) Inventors: Daisuke Fujii, Kawasaki; Kiyoshi Chinzei, Hyogo; Naoto Hirao, Kawasaki; Amiko Chihara, Kawasaki; Hiroaki Yoshida, Kawasaki, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/481,695

(22) Filed: Jan. 12, 2000

(30) Foreign Application Priority Data

Feb. 3, 1999 (JP) ..... 11-026439

(51) Int. Cl.[7] ..... G03G 15/00
(52) U.S. Cl. ..... 399/45; 399/384
(58) Field of Search ..... 399/45, 384, 389, 399/301; 271/227, 228, 265.03

(56) References Cited

U.S. PATENT DOCUMENTS 4,885,613 * 12/1989 Kudoh et al. ..... 399/384
5,277,506 * 1/1994 Oda ..... 400/279
5,533,721 * 7/1996 Takeshimizu ..... 271/227 X
5,619,921 * 4/1997 Iijima et al. ..... 101/181
6,039,481 * 3/2000 Ham ..... 400/708

FOREIGN PATENT DOCUMENTS 58-98278 * 6/1983 (JP) .
10-316216 11/1998 (JP) .

* cited by examiner

*Primary Examiner*—Quana M. Grainger
(74) *Attorney, Agent, or Firm*—Armstrong, Westerman, Hattori, McLeland & Naughton, LLP

(57) ABSTRACT

An image forming apparatus includes a reverse side print mechanism for printing on the reverse side of continuous paper, a surface print mechanism for printing on the surface of the continuous paper, and a width detecting mechanism for detecting a width of the continuous paper. The apparatus further includes a controller which, based on the detected paper width, determines a print start position on the reverse side of the continuous paper and controls the reverse side print mechanism to start printing from the determined print start position. Thus, even if the paper width is changed, the reverse side print start position can be set to a predetermined position.

11 Claims, 17 Drawing Sheets

IMAGE FORMING APPARATUS WITH WIDTH DETECTION

BACKGROUND OF THE INVENTION

1. Field of the Invention

The present invention relates to an image forming apparatus which can automatically measure a width of a recording medium such as paper, facilitate determination of an image formation width, improve image transfer quality and further improve a control characteristic of an image formation start position.

2. Description of the Related Art

In an image forming apparatus, such as a printer, for forming an image including characters on a recording medium such as paper, an image formation width, such as a print width, is determined depending on a width of paper. Therefore, an operator uses a given setting means to set the paper width in advance so as to indirectly set the print width.

There is available such an image forming apparatus, wherein for automatically setting a paper width, sensors are disposed in a paper width direction near a paper feed means for detecting the paper width. However, printing is carried out with a given print width regardless of the detected paper width.

With the foregoing arrangement, no problem may be raised when an image is formed on only one side of the paper. This is because, in this case, a print start position (image formation start position) is unchanged even if a paper width is changed (the paper width is used only for determining a print end position).

On the other hand, in case of forming images on both sides of the paper, a change of the paper width cannot be dealt with. This is because a print start position is changed on the reverse of the paper depending on the paper width.

Further, in an image forming apparatus wherein toner is adhered to a charged drum and the paper is pressed thereupon to carry out image transfer, charging is caused from an end of the paper (in case of continuous paper, also via paper feed holes of the paper formed near the end thereof) to deteriorate the transfer quality (print quality). This is significant particularly in such an image forming apparatus wherein the paper width is changed.

Further, when high-priced photosensors are used as the foregoing sensors, the sensors are minimized in number and disposed only at positions corresponding to paper widths to be used. Thus, if a paper width which is not expected is used, the paper width cannot be detected.

SUMMARY OF THE INVENTION

Therefore, it is an object of the present invention to provide an image forming apparatus, wherein an image formation start position can be set to a predetermined position even when a width of a recording medium is changed, particularly in the apparatus which forms images on both sides of the recording medium.

It is another object of the present invention to provide an image forming apparatus whose transfer quality is excellent.

It is another object of the present invention to provide an image forming apparatus which can automatically detect a width of a recording medium having any width in a certain range with a simple structure.

According to one aspect of the present invention, there is provided an image forming apparatus comprising an image transfer assembly for performing image transfer onto a recording medium; and a controller which, based on a width of the recording medium, determines an image formation start position on the recording medium so as to control the image transfer onto the recording medium performed by the image transfer assembly.

With this arrangement, not only an image formation end position but also the image formation start position (print start position) are determined by the controller based on the detected width of the recording medium so that the image transfer onto the recording medium is implemented. Therefore, particularly in case of both-side printing wherein image transfer mechanisms of the image transfer assembly are provided at both sides of the recording medium, at least one of the image transfer mechanisms (reverse image transfer mechanism) performs the image transfer onto the recording medium from the image formation start position determined by the controller. Thus, even if the width of the recording medium is changed, the image formation start position can be set to a predetermined position.

According to another aspect of the present invention, there is provided an image forming apparatus comprising an image transfer assembly for performing image transfer onto a recording medium; a width detecting mechanism for detecting a width of the recording medium; a transfer inhibitor for preventing the image transfer onto the recording medium; and a controller which, based on the width of the recording medium detected by the width detecting mechanism, moves the transfer inhibitor from one end to the other end of the recording medium in a width direction thereof.

With this arrangement, the controller moves the transfer inhibitor to the other end of the recording medium in the width direction based on the detected width of the recording medium, so that the image transfer onto the recording medium at the other end thereof is prevented by the transfer inhibitor. Thus, even if the width of the recording medium is changed, the transfer inhibitor can always be moved to the other end of the recording medium to prevent charging at the other end thereof, thereby to avoid deterioration of the transfer quality.

According to another aspect of the present invention, there is provided an image forming apparatus comprising a home position detecting means for detecting a width detection start point of a recording medium, the home position detecting means provided at a fixed feed means for conveying one side of the recording medium; an end detecting means for detecting one end of the recording medium remote from the width detection start point in a width direction of the recording medium, the end detecting means provided at a movable feed means which is movable in the width direction and conveys the other side of the recording medium; and a measuring means which is moved between the home position detecting means and the end detecting means so as to measure a distance therebetween, the distance corresponding to a width of the recording medium.

With this arrangement, a width of a recording medium having any width in a certain range can be automatically detected with the simple structure.

If the measurement of the distance is carried out by moving the measuring means from the home position detecting means to the end detecting means, the end detecting means can always be reached finally. If the measuring means is moved in one of the directions from an arbitrary position, there is no guarantee that the end detecting means can be always reached. Further, even if the power once goes off, since the measuring means is moved from the width detection start point (home position), the accurate width measurement can be ensured after the power goes on.

If the power goes off, a change during the power being off is unknown. Thus, it is preferable that the measuring means is moved to measure the width of the recording medium when the power goes on.

It is preferable that the measuring means is moved to measure the width of the recording medium when the fixed feed means and the movable feed means are operated to automatically feed the recording medium. This is because it is possible that the width of the recording medium has been changed.

It is preferable that the measuring means is moved to measure the width of the recording medium when a change of a recording medium width is notified. It is possible that an operator changes a recording medium width for adjusting the tension of the recording medium after an automatic loading operation. It is also possible that the operator carries out manual setting of the recording medium. In these cases, it is necessary that the operator notifies the apparatus of the width change of the recording medium by, for example, pushing an automatic loading switch. In response to the notification, the measuring means is moved to measure the width of the recording medium.

It may be arranged that the measuring means continues to detect the end detecting means and, when the end detecting means is not detected by the measuring means, the measuring means is moved to measure the width of the recording medium assuming that a change of the recording medium width is detected. With this arrangement, the detection of the recording medium width change can be automatically achieved so that the width of the recording medium can be quickly measured.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings.

(First Embodiment)

Figure 1:
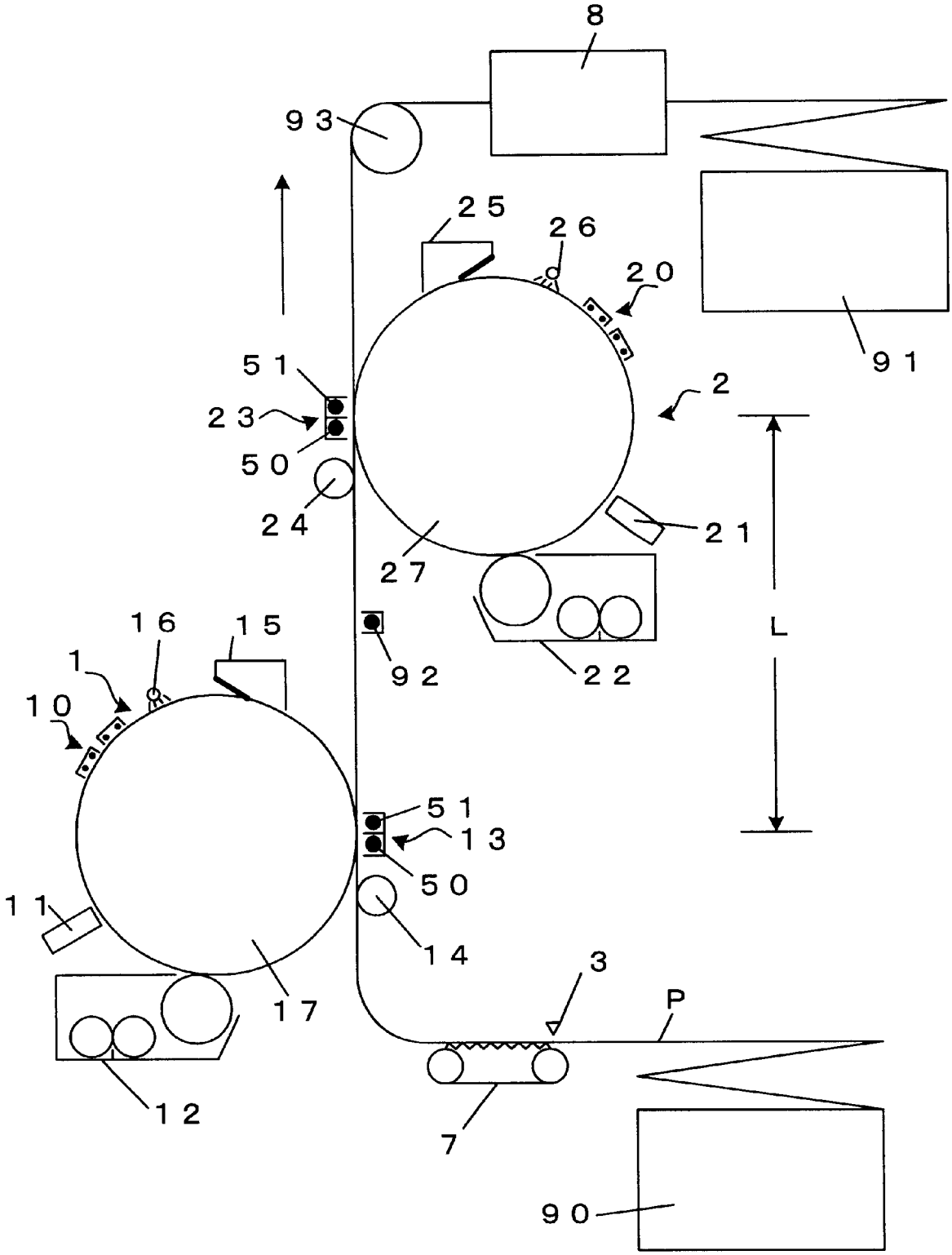
FIG. 1 is a diagram showing a schematic structure of an image forming apparatus with a both-side printing function according to a first preferred embodiment of the present invention.
Figure 2:
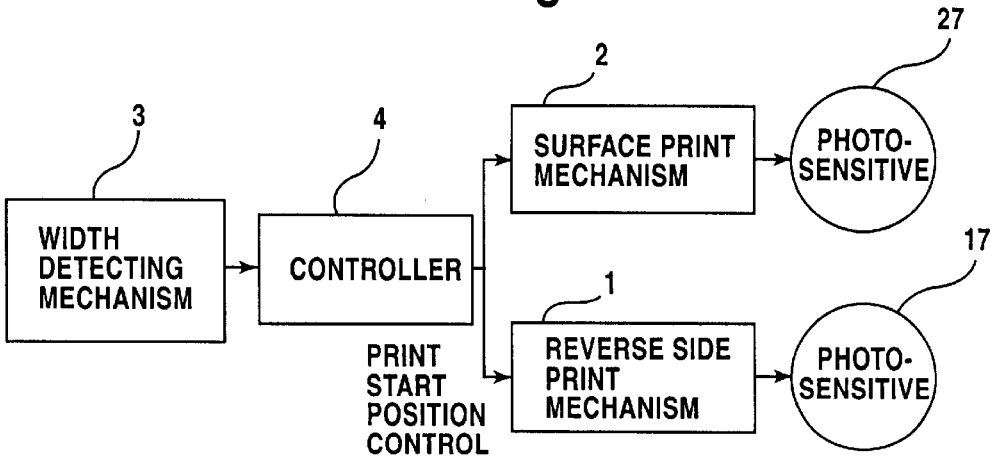
FIG. 2 is a block diagram showing components of the image forming apparatus shown in FIG. 1.

FIG. 1 shows a schematic structure of an image forming apparatus according to the first preferred embodiment of the present invention. The shown apparatus is capable of printing on both sides of continuous paper P having feed holes. FIG. 2 is a block diagram showing components of the image forming apparatus shown in FIG. 1. The image forming apparatus comprises an image transfer assembly having a reverse side print mechanism 1 and a surface print mechanism 2, a width detecting mechanism 3 for detecting a width of the continuous paper P, and a controller 4 for controlling image transfer performed by the image transfer assembly.

In FIG. 1, a hopper 90 stores a roll of the nonprinted continuous paper P. A paper feed tractor assembly 7 engages with the feed holes of the continuous paper P to feed the continuous paper P in a direction of an arrow. The reverse side print mechanism 1 is in the form of an electrophotography print mechanism and implements printing on the reverse side of the continuous paper P.

The reverse side print mechanism 1 comprises a photosensitive drum 17, a charging device 10 for charging the photosensitive drum 17, and an LED (light-emitting diode) head 11 for performing exposure to form a latent image on the photosensitive drum 17 per line. The LED head 11 comprises an LED array having LEDs arranged for one line.

A developing unit 12 develops the latent image on the photosensitive drum 17. A transfer charging device 13 transfers a developed image on the photosensitive drum 17 onto the continuous paper P. During the transfer, a transfer guide roller 14 presses the continuous paper P against the photosensitive drum 17. On the other hand, during non-transfer, the transfer guide roller 14 is retreated to prevent a contact between the photosensitive drum 17 and the continuous paper P. A cleaner 15 recovers residual toner on the photosensitive drum 17. A removal lamp 16 removes residual charge on the photosensitive drum 17.

The surface print mechanism 2 is also in the form of an electrophotography print mechanism and performs printing on the surface of the continuous paper P. The surface print mechanism 2 is disposed downstream of the reverse side print mechanism 1 relative to a paper feed direction.

The surface print mechanism 2 comprises a photosensitive drum 27, a charging device 20 for charging the photosensitive drum 27, and an LED head 21 for performing exposure to form a latent image on the photosensitive drum 27 per line. The LED head 21 comprises an LED array having LEDs arranged for one line.

A developing unit 22 develops the latent image on the photosensitive drum 27. A transfer charging device 23 transfers a developed image on the photosensitive drum 27 onto the continuous paper P. During the transfer, a transfer guide roller 24 presses the continuous paper P against the photosensitive drum 27. On the other hand, during non-transfer, the transfer guide roller 24 is retreated to prevent a contact between the photosensitive drum 27 and the continuous paper P. A cleaner 25 recovers residual toner on the photosensitive drum 27. A removal lamp 16 removes residual charge on the photosensitive drum 27.

A neutralizing device 92 is arranged between the reverse side print mechanism 1 and the surface print mechanism 2 and neutralizes the charge on the surface of the continuous paper P applied at the reverse side print mechanism 1. This ensures a stable transfer operation at the surface print mechanism 2.

A guide roller 93 changes a feed direction of the continuous paper P from vertical to horizontal for leading to a fixing unit 8 of a flash type. The fixing unit 8 fixed toner images on both sides of the continuous paper P. A stacker 91 stacks the printed continuous paper P.

In the image forming apparatus, the reverse side print mechanism 1 starts printing prior to the surface print mechanism 2. Further, a paper feed path is vertically arranged, and the reverse side print mechanism 1 and the surface print mechanism 2 are disposed on opposite sides of the paper feed path. This can reduce the size of the image forming apparatus of the both-side printing type.

Figure 3:
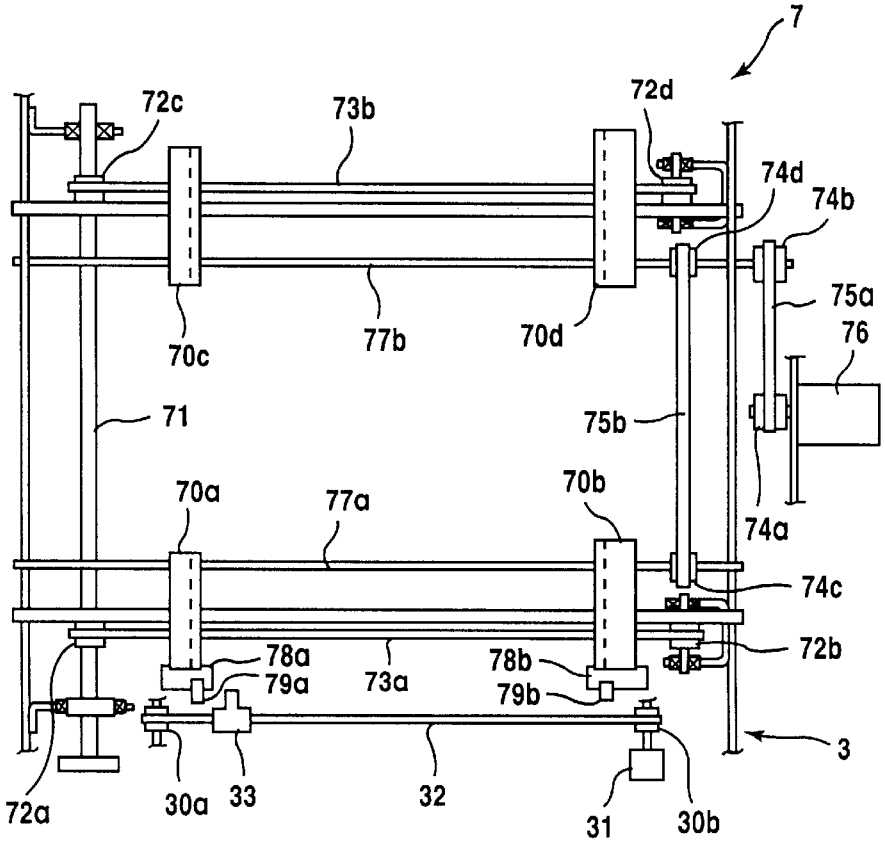
FIG. 3 is a plan view showing structures of a paper feed tractor assembly and a width detecting mechanism of the image forming apparatus shown in FIG. 1.

As shown in FIG. 3, the width detecting mechanism 3 is disposed adjacent to the paper feed tractor assembly 7. The paper feed tractor assembly 7 comprises a pair of upstream tractors 70*a* and 70*b* and a pair of downstream tractors 70*c* and 70*d*. Each of the left (in FIG. 3) tractors 70*a* and 70*c* is fixed while each of the right tractors 70*b* and 70*d* is movable in a direction perpendicular to the paper feed direction. The right tractor 70*b* engages with a timing belt 73*a* extending via a pulley 72*a* fixed on a rotation shaft 71 and a pulley 72*b*. Similarly, the right tractor 70*d* engages with a timing belt 73*b* extending via a pulley 72*c* fixed on the rotation shaft 71 and a pulley 72*d*. Thus, by rotating the rotation shaft 71, the right tractors 70*b* and 70*d* move in the direction perpendicular to the paper feed direction. The tractors 70*a* to 70*d* are rotated synchronously with each other by means of rotation shafts 77*a* and 77*b* which are rotated by a motor 76 via pulleys 74*a* to 74*d* and timing belts 75*a* and 75*b*, so as to convey the continuous paper P.

Figure 4:
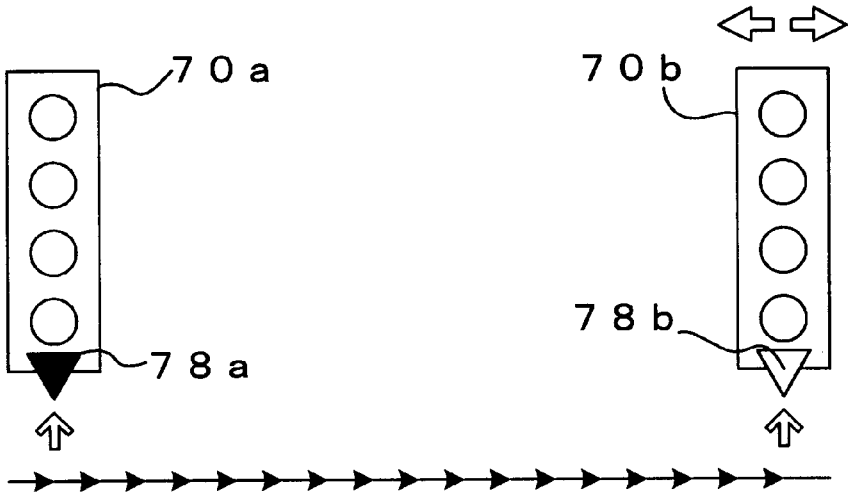
FIG. 4 is a diagram for explaining positions of sensors attached to upstream tractors of the paper feed tractor assembly shown in FIG. 3.
Figure 5:
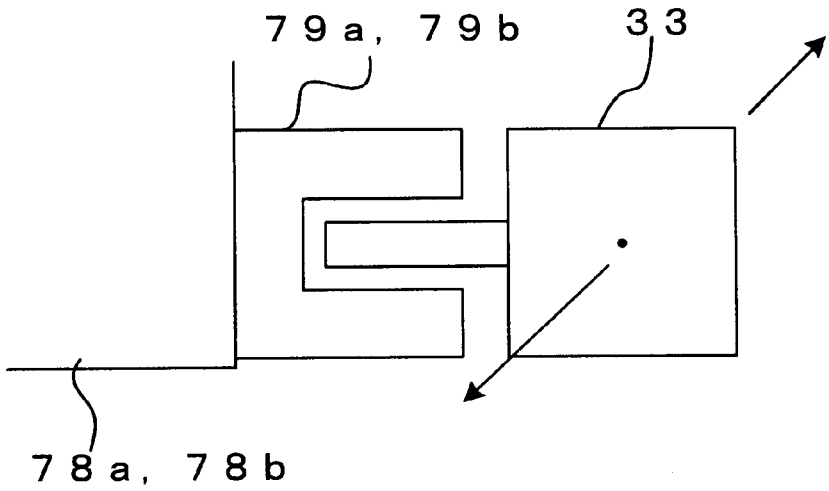
FIG. 5 is a diagram for explaining upstream portions with recesses of the sensors shown in FIG. 4.

As shown in FIG. 4, the upstream tractor 70*a* is provided with a sensor 78*a* for detecting a home position HP of the continuous paper P, while the upstream tractor 70*b* is provided with a sensor 78*b* for detecting the other end of the continuous paper P in a width direction thereof. As shown in FIG. 5, each of the sensors 78*a* and 78*b* has a portion 79*a*, 79*b* having a recess and projecting toward an upstream side relative to the paper feed direction. As shown in FIG. 3, the width detecting mechanism 3 comprises pulleys 30*a* and 30*b* arranged in a direction perpendicular to the paper feed direction, a stepping motor 31 for rotating the pulley 30*b*, a timing belt 32 extending between the pulleys 30*a* and 30*b*, a guide 33 fixed to the timing belt 32 and having a piece in the form a photosensor which is insertable into the recess of each of the portions 79*a* and 79*b* of the sensors 78*a* and 78*b*, and a measurement circuit (not shown) for counting pulses of the stepping motor 31 from a time point where the guide 33 detects the recess of the portion 79*a*, to a time point where the guide 33 detects the recess of the portion 79*b*, so as to measure a distance therebetween.

The sensor 78*a* can always detect the home position HP of the continuous paper P without moving the tractors 70*a* and 70*c*. On the other hand, when changing a paper width, an operator rotates the rotation shaft 71 to move the right tractors 70*b* and 70*d* in the direction perpendicular to the paper feed direction, thereby to carry out position setting of the tractors 70*b* and 70*d*. In this event, the sensor 78*b* detects the other end of the changed continuous paper P in the width direction. Then, the operator sets the continuous paper P on the tractors 70*a* to 70*d* by pushing an automatic loading switch or the like, thereby to carry out paper feeding.

When the automatic loading switch or the like is pushed (or when a power switch is turned on) after the continuous paper P is set on the tractors 70*a* to 70*d*, the measurement circuit of the width detecting mechanism 3 once moves the guide 33 toward the home position HP side and then moves it toward the other side where the sensor 78*b* is provided, so as to count pulses of the stepping motor 31 from a time point where the guide 33 detects the recess of the portion 79*a*, to a time point where the guide 33 detects the recess of the portion 79*b*, thereby to measure a distance therebetween as described above.

Figure 6:
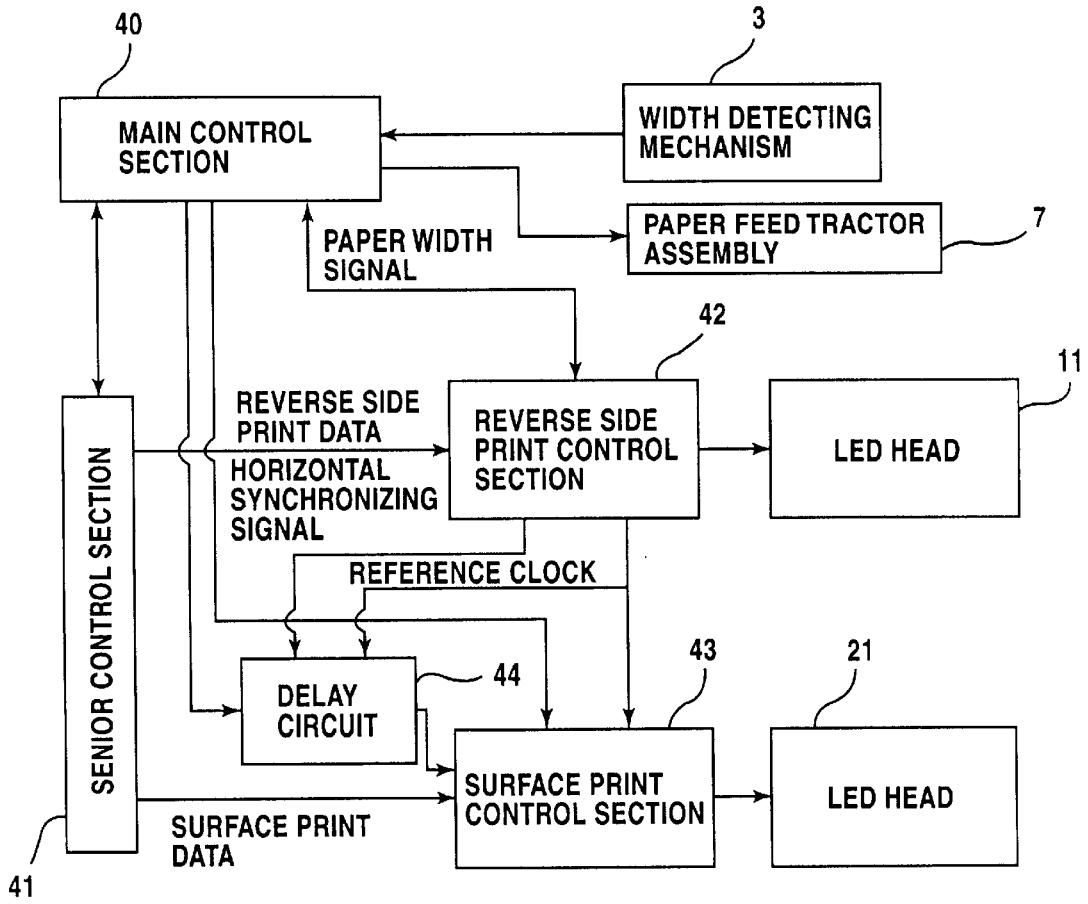
FIG. 6 is a circuit block diagram of a controller of the image forming apparatus shown in FIG. 2.
Figure 7:
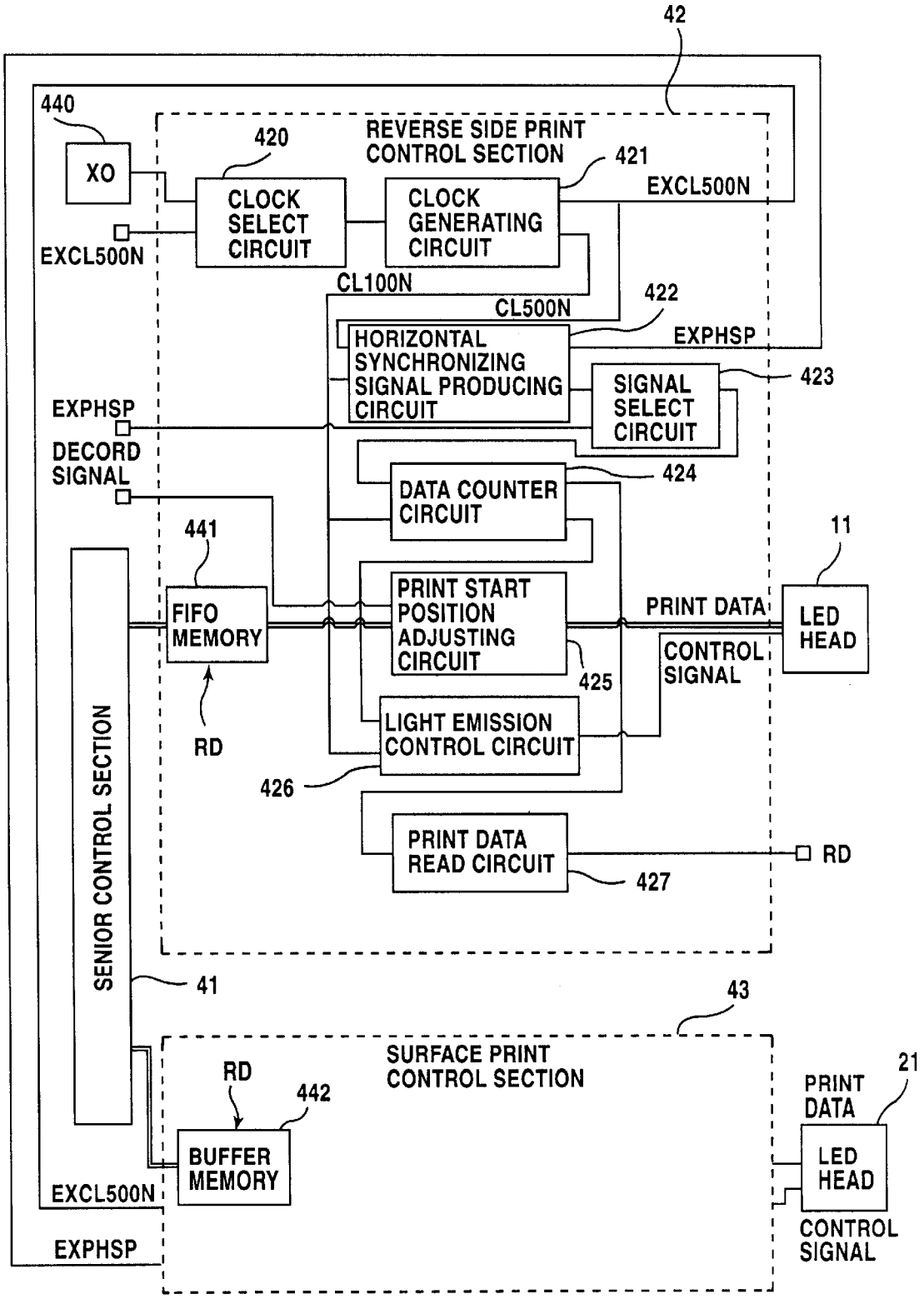
FIG. 7 is a circuit diagram of print control sections of the controller shown in FIG. 6.
Figure 8:
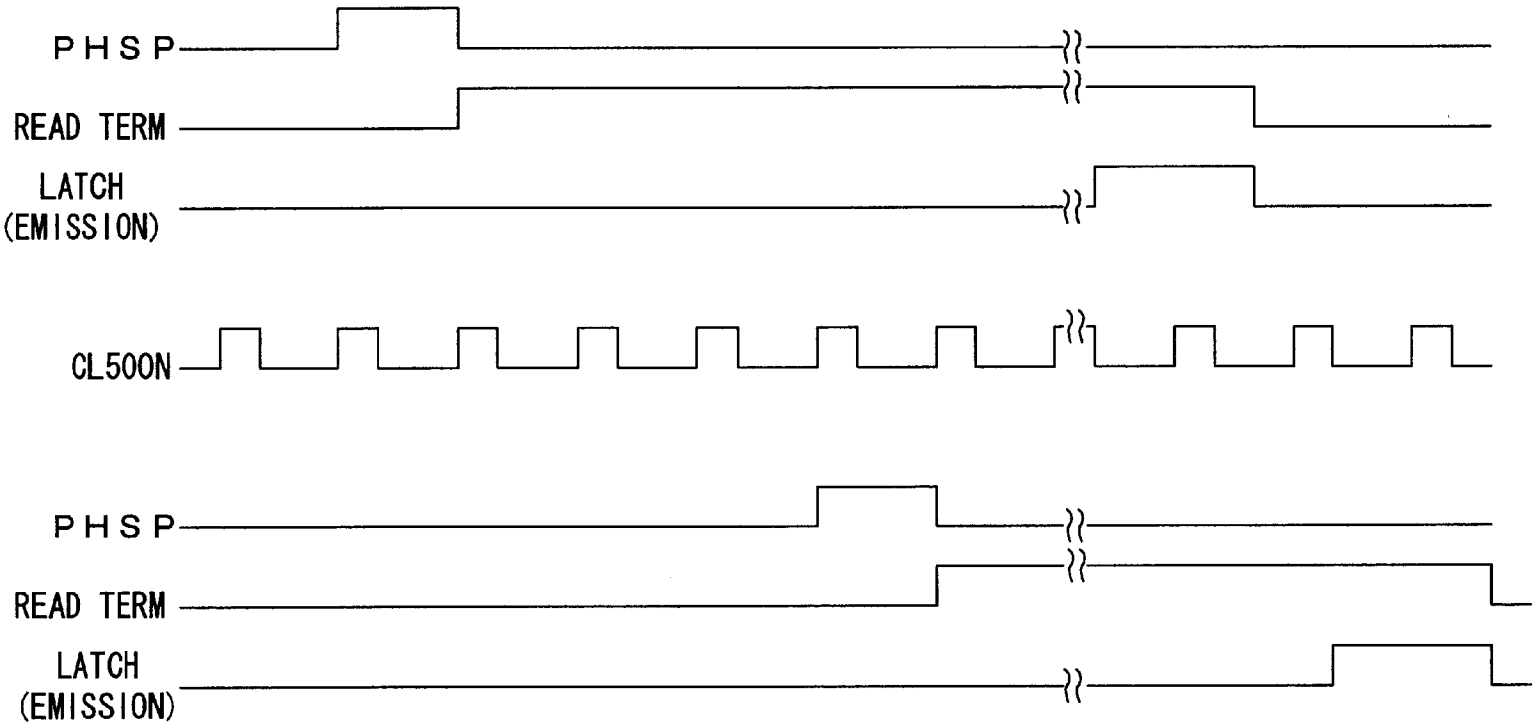
FIG. 8 is a time chart of the print control sections of the controller shown in FIG. 6.

The controller 4 determines a print start position based on a width of the continuous paper P detected by the width detecting mechanism 3 and controls image transfer performed by the image transfer assembly. FIG. 6 is a circuit block diagram of the controller 4. FIG. 7 is a circuit diagram of print control sections of the controller 4. FIG. 8 is a time chart of the print control sections of the controller 4.

A main control section 40 is in the form of a microprocessor and performs a control described below. A senior control section 41 expands print data transferred from a host computer and outputs print data 1 for the reverse side of the continuous paper P and print data 2 for the surface of the continuous paper P. A reverse side print control section 42 controls the LED head 11 for the paper reverse side. Specifically, the reverse side print control section 42 produces a horizontal synchronizing signal PHSP (see FIG. 7), outputs reverse side print data to the reverse side LED head 11 per line according to the horizontal synchronizing signal PHSP, and further outputs a print control signal (see FIG. 7) to the reverse side LED head 11.

A surface print control section 43 controls the LED head 21 for the paper surface. Specifically, the surface print control section 43 outputs surface print data to the surface LED head 21 per line according to the horizontal synchronizing signal PHSP and a reference clock signal EXCL500N (see FIG. 7), and further outputs a print control signal (see FIG. 7) to the surface LED head 21.

As described later referring to FIG. 7, the reverse side print control section 42 and the surface print control section 43 are composed of the same circuits, respectively. The surface print control section 43 implements a print control based on a new horizontal synchronizing signal PHSP produced by a delay circuit 44 based on the horizontal synchronizing signal PHSP produced by the reverse side print control section 42 and the reference clock signal EXCL500N. The delay circuit 44 delays the horizontal synchronizing signal PHSP from the reverse side print control section 42 by a predetermined time so as to produce the new horizontal synchronizing signal PHSP for a surface print control.

As described above, in this embodiment, the reverse side print control section 42 produces the horizontal synchronizing signal PHSP for controlling an exposure start timing and controls printing according to this horizontal synchronizing signal PHSP. On the other hand, the surface print control section 43 delays the horizontal synchronizing signal PHSP from the reverse side print control section 42 at the delay circuit 44 so as to produce the new horizontal synchronizing signal PHSP and controls printing in accordance therewith. Therefore, even if the reverse and surface print control sections 42 and 43 are provided for the reverse side and surface print mechanisms, respectively the reverse side print control and the surface print control can be synchronized so that a print dislocation between the reverse side and the surface can be prevented.

The reverse side LED head 11 starts exposure prior to the surface LED head 21. Specifically, the surface LED head 21 starts exposure after a lapse of a time from the start of exposure at the reverse LED head 11, which time is predetermined according to positions of the photosensitive drums 17 and 27 and positions of the LED heads 11 and 21.

Thus, the delay circuit 44 delays a reverse horizontal synchronizing signal PHSP by a predetermined time to produce a surface horizontal synchronizing signal PHSP. By adjusting this delay time, a print dislocation between the reverse side and surface of the continuous paper P can be prevented despite a difference in transfer position relative to the continuous paper P.

A delay time of the delay circuit 44 can be adjusted depending on a distance L between a reverse side transfer position and a surface transfer position and positions of the LED heads. For example, the delay circuit 44 is constituted of a counter. Then, a delay time is set in the counter to delay a horizontal synchronizing signal PHSP by the delay time, thereby to produce a new horizontal synchronizing signal PHSP. The setting of the delay time is performed by the main control section 40.

Further, it is preferable that print start positions relative to the continuous paper P in the paper feed direction are adjusted independently of each other between the reverse side and the surface. Specifically, a print start position to be exposed by the reverse side LED head 11 is adjusted by changing a paper feed start timing of the paper feed tractor assembly 7 shown in FIG. 6. The main control section 40 controls this paper feed start timing of the paper feed tractor assembly 7. Then, a print start position to be exposed by the surface LED head 21 is adjusted by a delay time of the delay circuit 44 which depends on a change of the paper feed start timing. The main control section 40 controls the delay time of the delay circuit 44 as described above. With this arrangement, the print start positions in the paper feed direction can be adjusted independently between the reverse side and surface of the continuous paper P.

Further, in this embodiment, a print start position in a direction perpendicular to the paper feed direction can be adjusted by the controller 4. Specifically, the controller 4 determines the print start position in the direction perpendicular to the paper feed direction based on a width of the continuous paper P detected by the width detecting mechanism 3 and executes a print control of the reverse side print mechanism 1.

Figure 9:
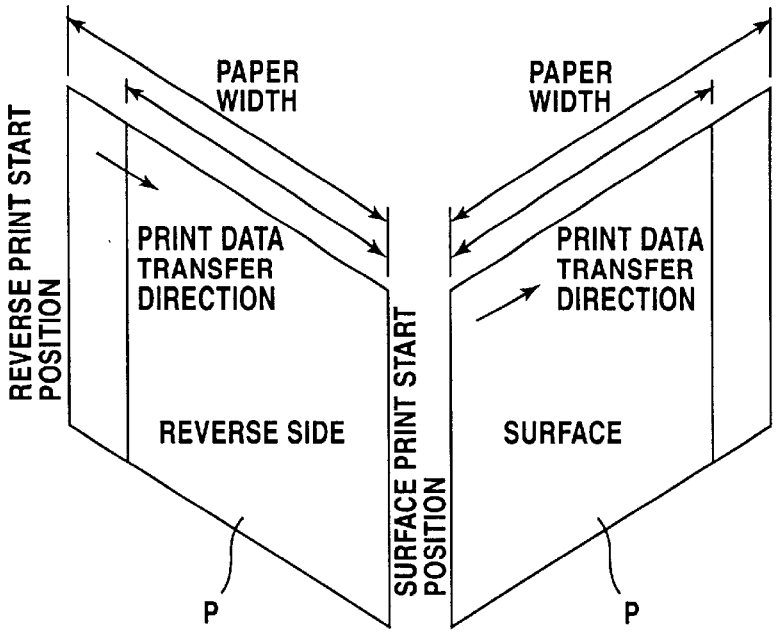
FIG. 9 is a diagram for explaining reverse and surface print start positions.
Figure 10:
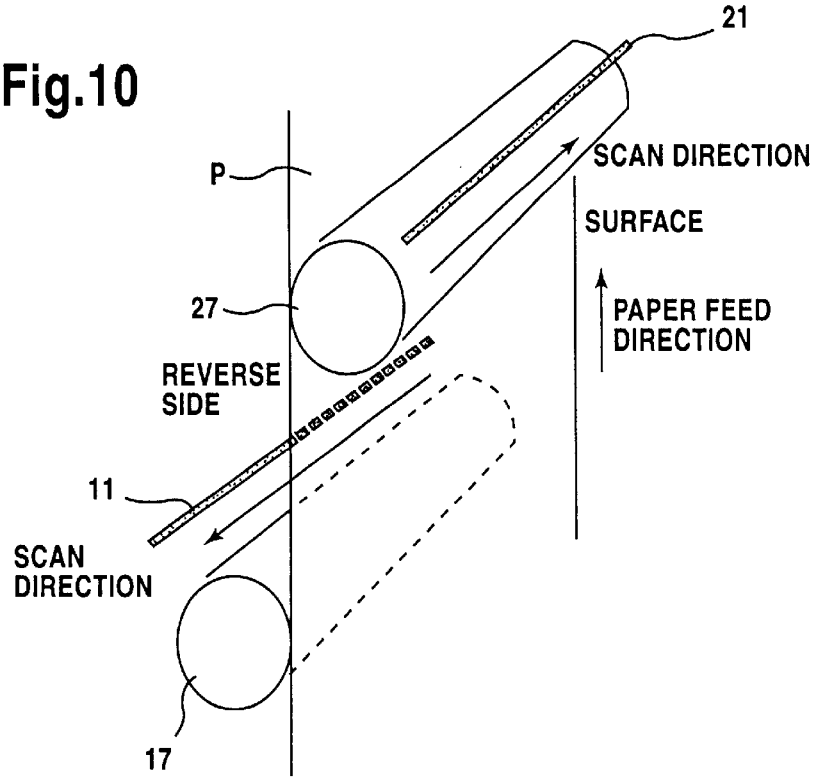
FIG. 10 is a diagram for explaining scan directions of LED heads.
Figure 11:
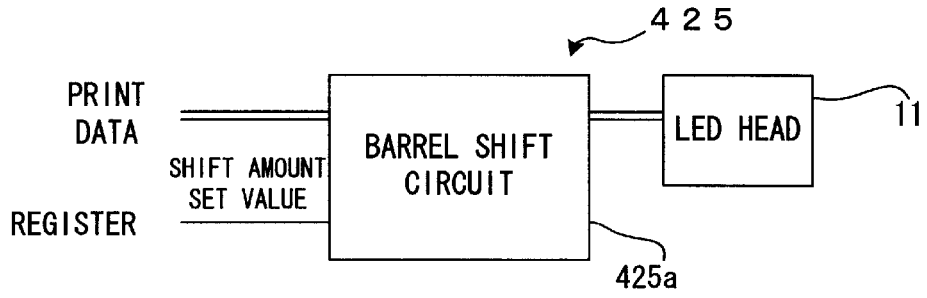
FIG. 11 is a diagram for explaining a shift of print data performed by a print start position adjusting circuit of the print control section shown in FIG. 7.

As shown in FIGS. 9 and 10, since the LED heads 11 and 21 are arranged so as to cause print data transfer directions (scan directions) to be opposite between the reverse side and the surface, print data shift directions (scan directions) become opposite between the reverse side and the surface. In this case, it is necessary to change print start positions for printing on paper of various widths. As shown in FIG. 9, it is not necessary to change a print start position of one-line print data on the surface even if a paper width is changed, while a print start position of one-line print data on the reverse side should be changed depending on a paper width. Therefore, a reverse side print start position adjusting circuit 425 (see FIG. 7) shifts reverse side print data in a line direction according to a paper width signal from the main control section 40 (a signal produced by the main control section 40 corresponding to a width of the continuous paper P detected by the width detecting mechanism 3). As described later, the main control section 40 decodes the paper width signal sent from the measurement circuit of the width detecting mechanism 3 to convert it into a shift amount set value and sends it to the print start position adjusting circuit 425. As shown in FIG. 11, the shift amount set value is stored into a register of the print start position adjusting circuit 425 and then inputted into a barrel shift circuit 425a which shifts the reverse side print data to a print start position on the reverse side of the continuous paper P.

Referring to FIG. 7, the reverse side and surface print control sections 42 and 43 will be described in detail. The reverse side print control section 42 comprises a clock select circuit 420, a clock generating circuit 421, a horizontal synchronizing signal producing circuit 422, a signal select circuit 423, a data counter circuit 424, a print start position adjusting circuit 425, a light emission control circuit 426 and a print data read circuit 427. Similarly, the surface print control section 43 comprises a clock select circuit 430, a clock generating circuit 431, a horizontal synchronizing signal producing circuit 432, a signal select circuit 433, a data counter circuit 434, a print start position adjusting circuit 435, a light emission control circuit 436 and a print data read circuit 437 which are connected in the same manner as the circuits 420 to 427 of the reverse side print control section 42.

The clock generating circuit 421 (431) is in the form of a divider circuit which produces reference clock pulses CL100N when clock pulses of an external crystal oscillator 440 are selected at the clock select circuit 420 (430), while outputs external reference clock pulses EXCL500N as they are when the external reference clock pulses EXCL500N are selected at the clock select circuit 420 (430). In this manner, the clock select circuit 420 (430) implements selection between the clock pulses of the crystal oscillator 440 and the external reference clock pulses EXCL500N depending on selection setting and outputs the selected clock pulses.

The horizontal synchronizing signal producing circuit 422 (432) counts the reference clock pulses CL500N and CL100N from the clock generating circuit 421 (431) to produce a horizontal synchronizing signal PHSP having a period corresponding to a set paper width.

The signal select circuit 423 (433) is inputted with the horizontal synchronizing signal PHSP from the horizontal synchronizing signal producing circuit 422 (432) and an external horizontal synchronizing signal EXPHSP, selects one of the produced horizontal synchronizing signal PHSP and the external horizontal synchronizing signal EXPHSP, depending, on selection setting, and outputs the selected signal.

The data counter circuit 424 (434) counts the reference clock pulses CL100N in synchronism with the selected horizontal synchronizing signal from the signal select circuit 423 (433). An output of the data counter circuit 424 (434) represents a position of data (dot data) from the horizontal synchronizing signal.

The print start position adjusting circuit 425 (435) adjusts a print start position depending on a paper width as shown in FIGS. 9 and 10. The print start position adjusting circuit 425 (435) shifts inputted print data according to a decoded signal (paper width signal) from the main control section 40.

The light emission control circuit 426 (436) produces a control signal for the LED head 11 (21) according to the output of the data counter circuit 424 (434). The control signal comprises a shift pulse depending on print data, a latch signal (see FIG. 8) for causing the LED head to latch print data, and an emission signal (see FIG. 8) for causing the LED head to emit light.

The print data read circuit 427 (437) produces a read address RD of a FIFO memory 441 (buffer memory 442) according to the output of the data counter circuit 424 (434).

The FIFO memory 441 buffers reverse print data from the senior control section 441. The FIFO memory 441 stores print data for two lines and implements speed absorption between the senior control section 41 and the reverse side print control section 42. The print data stored in the FIFO memory 441 is read per unit of 64 bits using a read address RD from the print data read circuit 427.

The buffer memory 442 buffers surface print data from the senior control section 41. As shown in FIG. 1, the transfer positions of the reverse side print mechanism 1 and the surface print mechanism 2 are separated from each other by a distance L. The senior control section 41 consecutively outputs print data for the surface (first page) and the reverse (second page). Thus, for matching printing on the surface and the reverse side, the surface print data should be outputted with a delay of the distance L relative to the reverse side print data.

The buffer memory 442 stores the surface print data for delaying the surface print data by the distance L. The print data stored in the buffer memory 442 is read per unit of 64 bits using a read address RD from the print data read circuit 437.

Further, the reverse side print start position adjusting circuit 425 shifts the reverse print data in a line direction according to the paper width signal (decoded signal) from the main control section 40. This is because, as described before, although a print start position of one-line print data on the surface is not changed even if a paper width is changed, a print start position of one-line print data on the reverse side is changed depending on a paper width.

Operations of the reverse side and surface print control sections 42 and 43 will be described in further detail. The crystal oscillator 440 is connected to the reverse side print control section 42. The clock select circuit 420 of the reverse side print control section 42 is set to select the clock pulses of the crystal oscillator 440 or the external reference clock pulses EXCL500N. The signal select circuit 423 of the reverse side print control section 42 is set to select the internal horizontal synchronizing signal PHSP or the external horizontal synchronizing signal EXPHSP.

In the surface print control section 43, the clock select circuit 430 is set to select clock pulses of a crystal oscillator (not shown) or the reference clock pulses EXCL500N outputted from the reverse side print control section 42. The signal select circuit 433 of the surface print control section 43 is set to select the internal horizontal synchronizing signal PHSP or the horizontal synchronizing signal EXPHSP outputted from the reverse side print control section 42. The signal select circuit 433 is inputted with a horizontal synchronizing signal, which is obtained by delaying the horizontal synchronizing signal EXPHSP from the reverse side print control section 42 at the delay circuit 44, as an external horizontal synchronizing signal EXPHSP.

Accordingly, in the reverse side print control section 42, the circuits 422.424 and 426 are operated based on the reference clock pulses CL500N and CL100N produced by the clock generating circuit 421. The data counter circuit 424 produces a counter value representing a position of print data based on the horizontal synchronizing signal PHSP produced by the horizontal synchronizing signal producing circuit 422.

According to the counter value, the print data read circuit 427 reads print data from the FIFO memory 441. The read print data is sent to the print start position adjusting circuit 425.

On the other hand, the main control section 40 decodes a paper width signal sent from the measurement circuit of the width detecting mechanism 3 to convert it into a shift amount set value and sends it to the print start position adjusting circuit 425. As shown in FIG. 11, the print start position adjusting circuit 425 is provided with the register for storing the shift amount set value and the barrel shift circuit 425*a*. The barrel shift circuit 425*a* is inputted with the shift amount set value from the register so as to shift the print data to a print start position on the reverse of the continuous paper P.

Then, the print data is outputted to the LED head 11 per line. In synchronism with this read operation, the light emission control circuit 426 produces a shift pulse, a latch signal (see FIG. 8) and an emission, signal (see FIG. 8) and outputs them to the LED head 11. The LED head 11 implements light emission as described later with reference to FIG. 12.

In the surface print control section 43, the circuits 432, 434 and 436 are operated based on the reference clock pulses EXCL500N produced by the clock generating circuit 421 of the reverse side print control section 42. The data counter circuit 434 produces a counter value representing a position of print data according to the horizontal synchronizing signal obtained by delaying the horizontal synchronizing signal EXPHSP produced by the horizontal synchronizing signal producing circuit 422 of the reverse side print control section 42.

According to the counter value, the print data read circuit 437 reads print data from the buffer memory 442. The read print data is outputted to the LED head 21 per line via the print start position adjusting circuit 435. In synchronism with this read operation, the light emission control circuit 436 produces a shift pulse, a latch signal (see FIG. 8) and an emission signal (see FIG. 8) and outputs them to the LED head 21. The LED head 21 implements light emission, as described later with reference to FIG. 12.

As described above, since the reference clock pulses and the horizontal synchronizing signal of the reverse side print control section 42 are used for the reference clock pulses and the horizontal synchronizing signal of the surface print control section 43, the print positions on the reverse side and surface of the continuous paper P can be matched even if the print controls are executed independently of each other between the reverse side and the surface.

Figure 12:
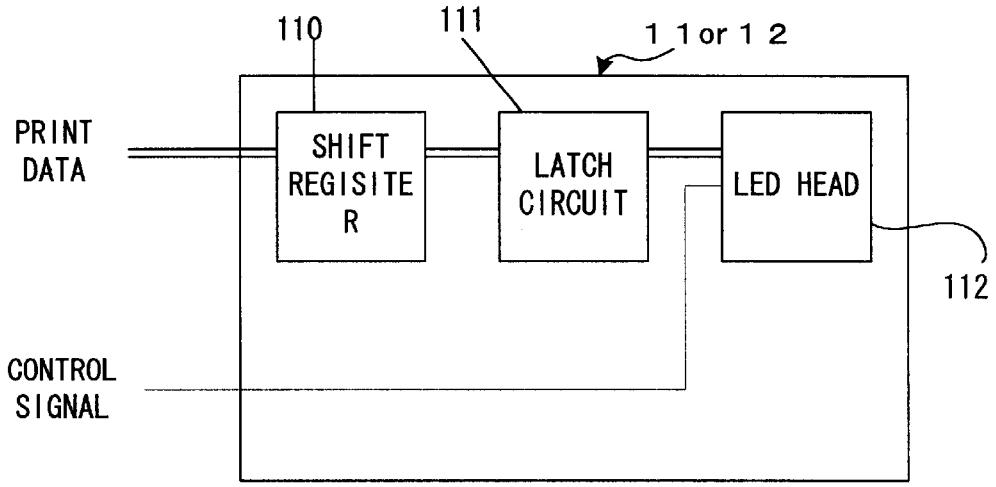
FIG. 12 is a block diagram of the LED head.

FIG. 12 is a block diagram of the LED head 11 (21) shown in FIGS. 6 and 7.

As shown in FIG. 12, the LED head 11 (21) has a shift register 110 for shifting serial print data. The shift register 110 has the number of bits corresponding to the number of light-emitting diodes and shifts the print data in response to a shift pulse. A latch circuit 111 is further provided at an output side of the shift register 110 for latching print data from the shift register 110 in response to a latch signal.

At an output side of the latch circuit 111, an LED array 112 is further provided for emitting light in response to an emission signal from the light emission control circuit 426 or 436. The LED array 112 is arranged along the photosensitive drum 17 or 27 for one-line print dots.

The print data shift directions (scan directions) are set to be opposite between the reverse side and the surface. As described above (see FIGS. 9 and 10), the LED heads 11 and 21 are arranged so as to cause the print data transfer directions (scan directions) to be opposite between the reverse side and the surface.

If the print data transfer directions are the same with each other on the reverse and the surface, it is necessary that the print control section or the senior control section causes the reverse side or surface print data to be reversed. In this embodiment, since the scan directions of the LED heads 11 and 21 are set to be opposite, a complicated process of reversing the reverse side or surface print data is not required at the print control section or the senior control section.

In this embodiment, a transfer inhibiting mechanism is further provided at each of the reverse side print mechanism 1 and the surface print mechanism 2 for preventing printing, i.e. image transfer, onto the continuous paper P.

The transfer inhibiting mechanism comprises a transfer inhibitor 5 which is provided at each of the transfer charging devices 13 and 23 and also serves as a cleaner 52.

As shown in FIG. 1, the transfer charging device 13 (23) is disposed at the side opposite to the photosensitive drum 17 (27) with respect to the continuous paper P and serves to transfer a developed image on the photosensitive drum 17 (27) onto the continuous paper P. For the image transfer, as shown in FIG. 1, the transfer charging device 13 (23) is provided at an upstream side in the paper feed direction with an extending transfer wire 50 which charges the continuous paper P for adhesion of toner thereto. On the other hand, an extending AC separation wire 51 is further provided adjacent to and downstream of the transfer wire 50 for performing charge removal so as to separate the charged paper from the transfer charging device 13 (23).

Figure 13:
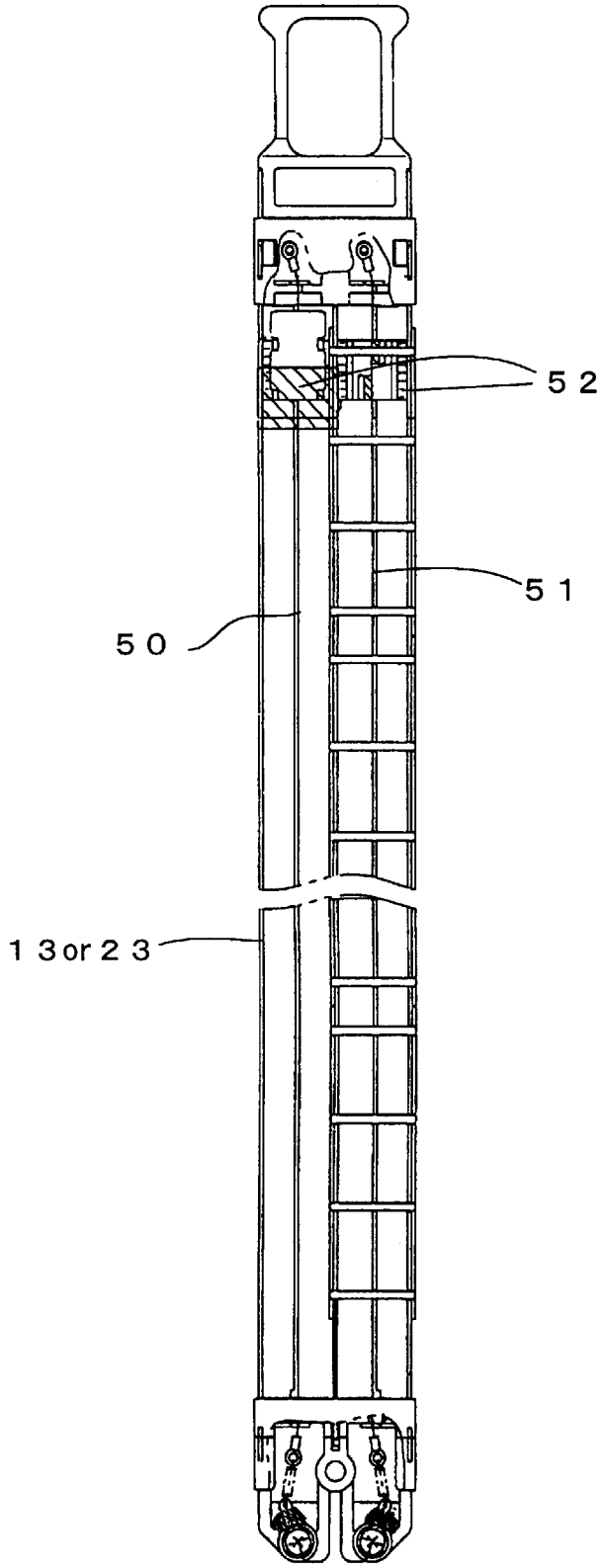
FIG. 13 is a front view of a transfer charging device of the image forming apparatus shown in FIG. 1 for explaining a structure of a cleaner which also serves as a transfer inhibitor.
Figure 14:
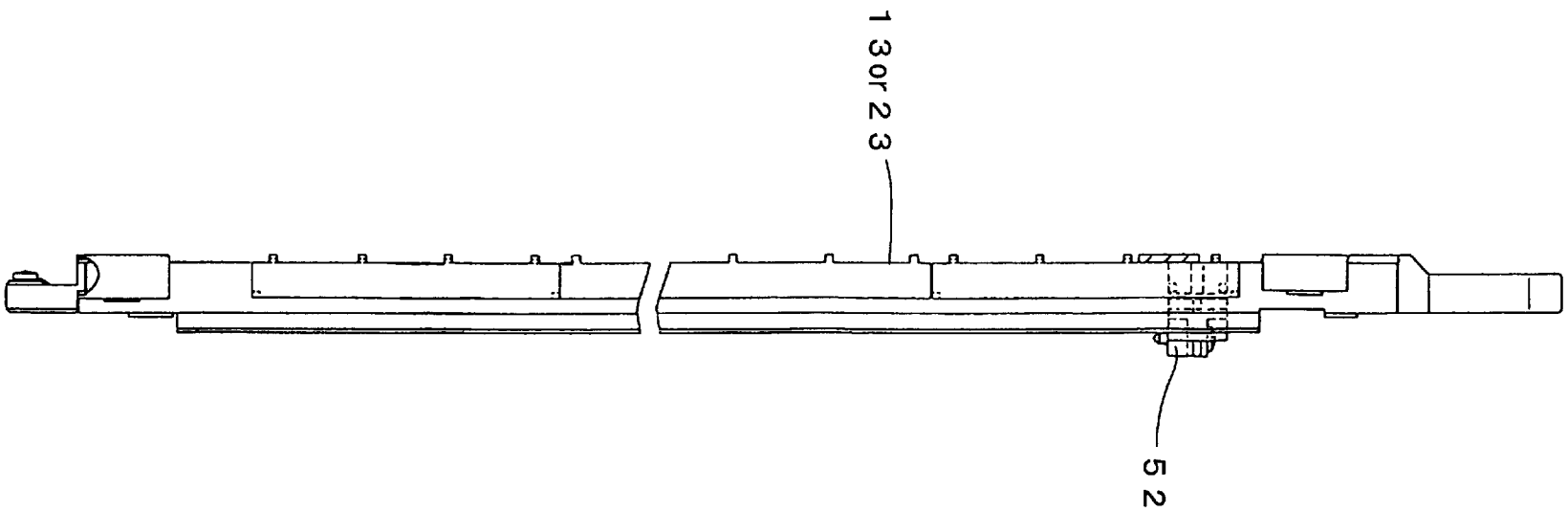
FIG. 14 is a bottom view of FIG. 13.
Figure 15:
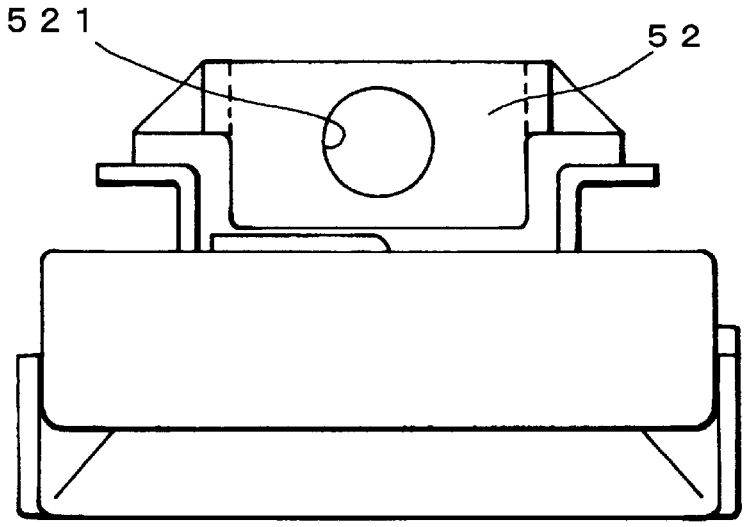
FIG. 15 is a side view of FIG. 13.
Figure 16:
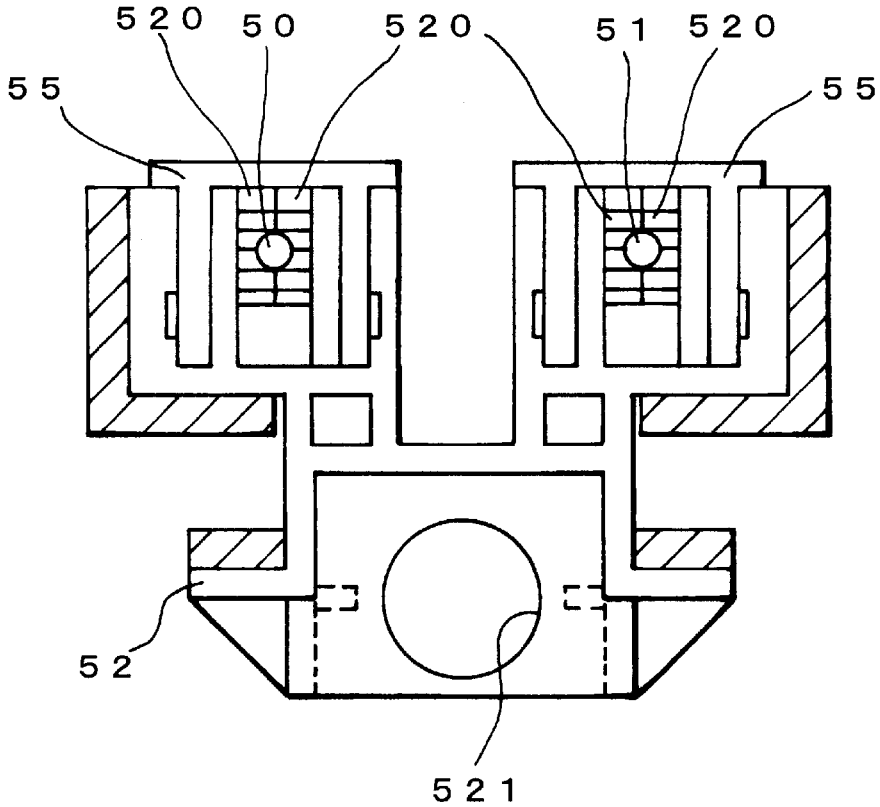
FIG. 16 is a sectional view for explaining the structure of the cleaner wherein the cleaner straddles a transfer wire and an AC separation wire in the transfer charging device.
Figure 17:
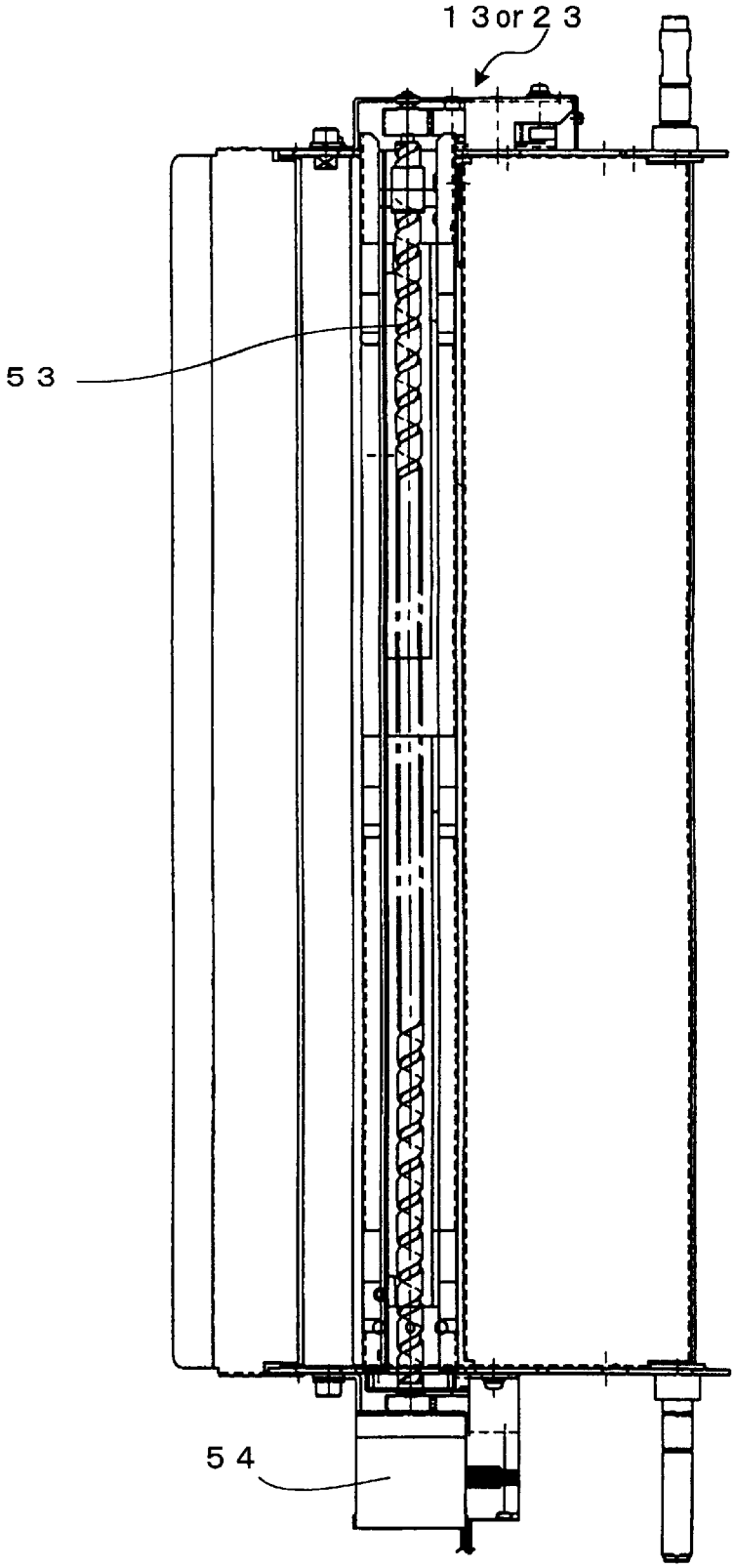
FIG. 17 is a front view of the transfer charging device for showing a screw which is used for moving the cleaner along the transfer wire and the AC separation wire.

As shown in FIGS. 13 to 15, the cleaner 52 (transfer inhibitor 5) is provided so as to slide on the transfer wire 50 and the AC separation wire 51 in a longitudinal direction thereof (paper width direction). As shown in FIG. 16, the cleaner 52 is arranged to straddle the transfer wire 50 and the AC separation wire 51 and has a pair of cleaner pads 520 which are disposed to confront each other inside the cleaner 52 and contact the circumferences of the wires 50 and 51, respectively. By moving the cleaner 52 along the wires 50 and 51, adhering matter on the surfaces of the wires can be removed. For moving the cleaner 52, as shown in FIG. 17, the transfer charging device 13 (23) is further provided with a screw 53 disposed along the wires 50 and 51 and a cleaner motor 54 fixed at one end of the screw 53 for rotating it, and the screw 53 is threaded into a screw hole 521 of the cleaner 52.

An operation of the motor 54 is controlled by the main control section 40. Normally, the main control section 40 drives the motor 54 just after the power switch of the image forming apparatus is turned on or during an idle state of the apparatus, so as to clean the surfaces of the wires 50 and 51.

Figure 18:
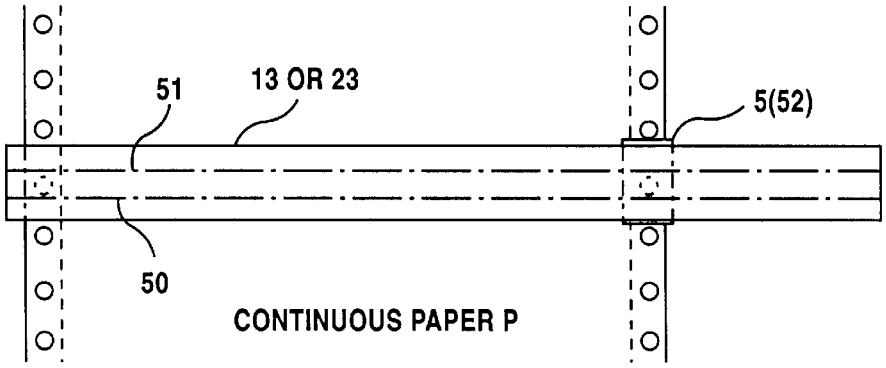
FIG. 18 is a diagram for explaining a state wherein the cleaner is moved to a paper end remote from a home position in a paper width direction.

After the paper width is detected by the width detecting mechanism 3, the main control section 40 moves the cleaner 52, which also serves as the transfer inhibitor 5, in the paper width direction away from the home position HP of the continuous paper P as shown in FIG. 18. In this event, the main control section 40 controls the motor 54 while counting the number of rotation pulses of the motor 54, so that the cleaner 52 can be moved to a target position, i.e. to the other end of the continuous paper P remote from the home position HP. As described above, since the cleaner pads 520 are disposed to cover the circumferences of the wires 50 and 51, the cleaner 52 (transfer inhibitor 5) screens the continuous paper P from transfer charging by the transfer charging device 13 (23). Thus, even if a width of the continuous paper P is changed, the transfer inhibitor 5 can be always moved to the end of the continuous paper P so as to prevent charging at the paper end including charging via the feed holes formed at the paper end, thereby to avoid deterioration of the transfer quality.

In this embodiment, as shown in FIG. 16, a cover 55 is further provided to cover an open side of each of the cleaner pads 520 so as to fully screen the continuous paper P from the transfer charging by the transfer charging device 13 (23).

FIGS. 19 to 22 are flowcharts showing operations of the image forming apparatus according to this embodiment.

Figure 19:
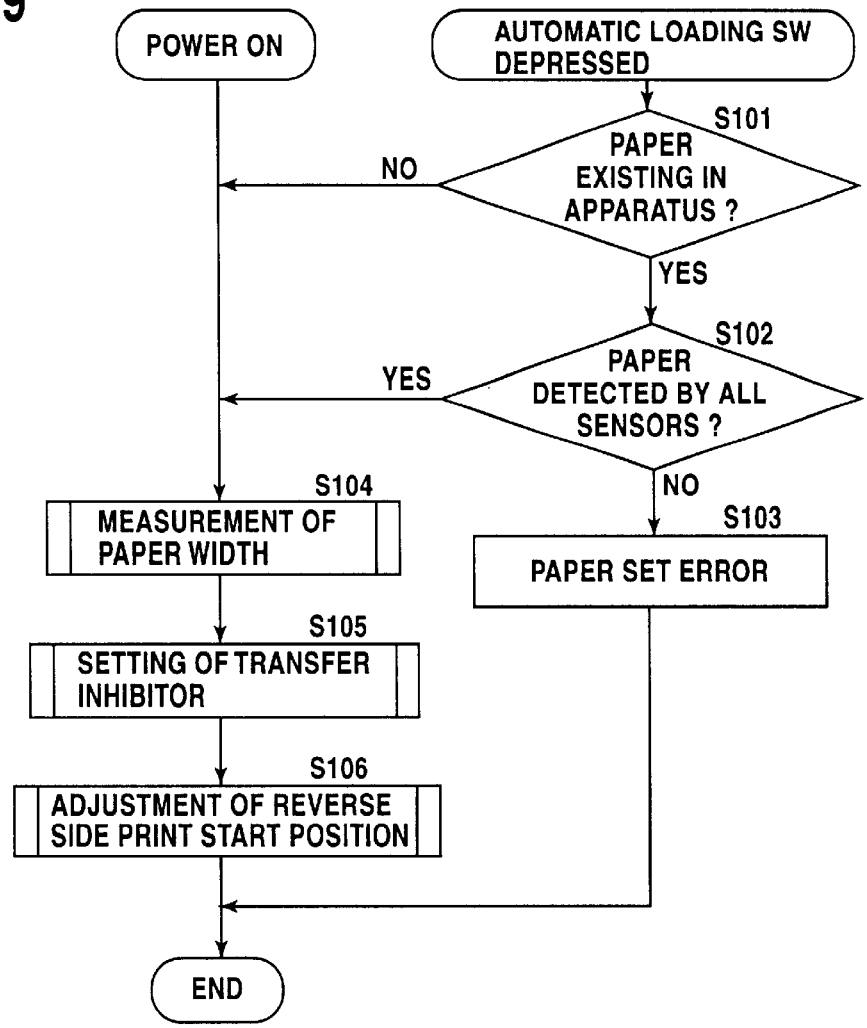
FIG. 19 is a flowchart showing an operation of the image forming apparatus shown in FIG. 1.

As shown in FIG. 19, when the power switch of the image forming apparatus is turned on, a paper width measurement is carried out in parallel to an initial operation (step S104). On the other hand, when the automatic loading switch is pushed by an operator after the power switch is turned on, it is checked using all paper detecting sensors whether or not there exists paper in the apparatus (step S101). If no paper exists in the apparatus (step S101: No), the paper width measurement is performed in parallel to the automatic loading operation (step S104). On the other hand, if paper exists in the apparatus (step S101: Yes), it is further checked whether paper is detected by all the paper detecting sensors (step S102). If paper is detected by all the paper detecting sensors (step S102: Yes), the paper width measurement is performed assuming that a paper width changing operation has been performed by the operator for adjusting the tension of paper or the automatic loading switch has been depressed to request only the paper width measurement after manual setting of paper by the operator (step S104). On the other hand, if paper is detected by a part of the paper detecting sensors and not by all the paper detecting sensors (step S102: No), since a piece of paper remains in the apparatus, the automatic loading operation can not be implemented. Thus, in this case, "paper set error" is displayed to request the operator to remove the paper piece and depress again the automatic loading switch (step S103).

After the paper width measurement is carried out, setting of the transfer inhibitor 5 (cleaner 52) is implemented based on the detected paper width (step S103), and then an adjustment of a print start position on the reverse side of the paper is implemented (step S106).

Figure 20:
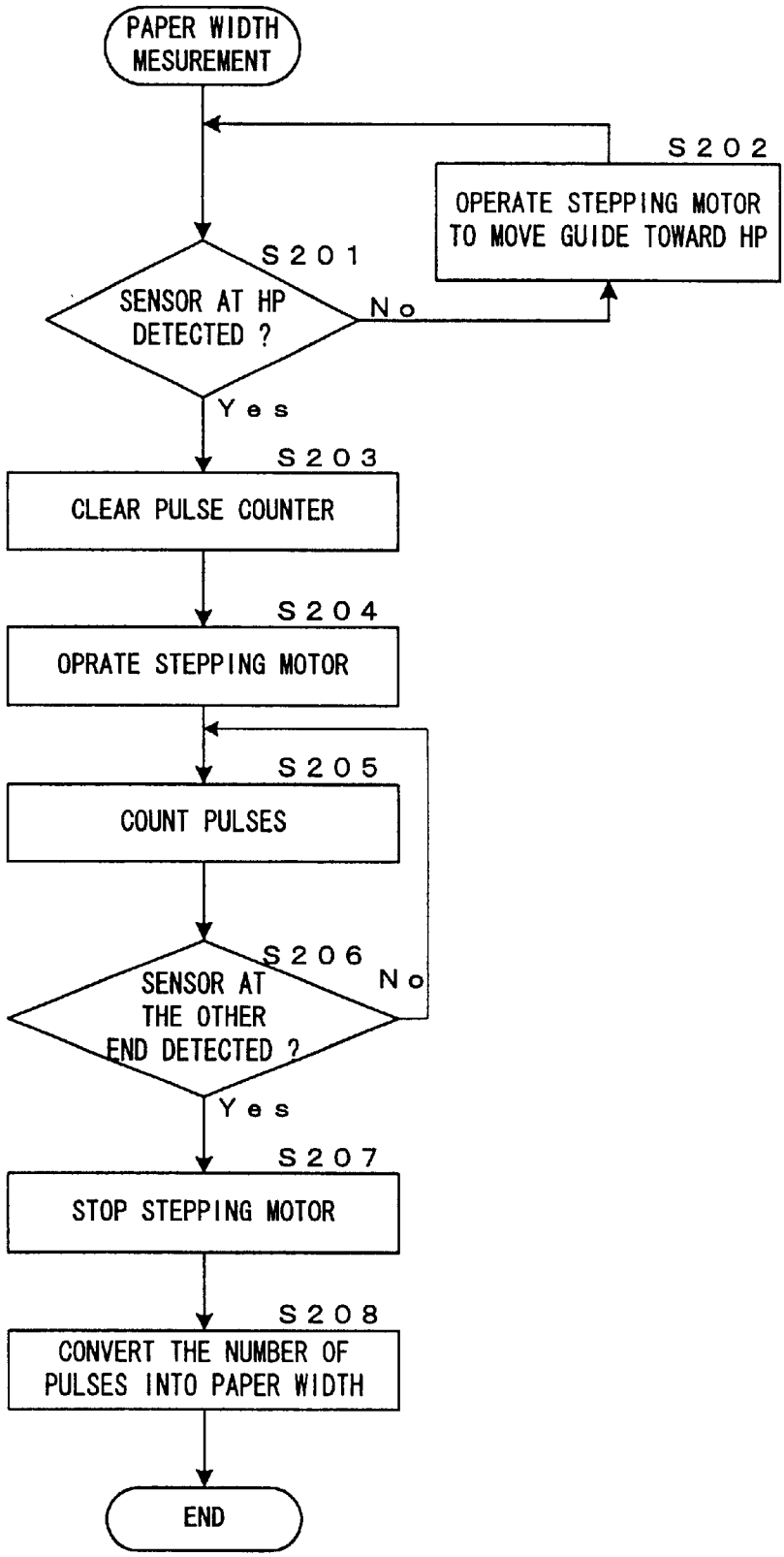
FIG. 20 is a flowchart showing details of a paper width measurement operation shown in FIG. 19.

The paper width measurement at step S104 is carried out as shown in FIG. 20. First, it is checked whether the guide 33 has detected the recess of the portion 79*a* of the sensor 78*a* at the side of the home position HP (step S201). If not having detected it (step S201: No), the stepping motor 31 is operated to move the guide 33 toward the home position HP (step S202) and step S201 is executed again. On the other hand, if the guide 33 has detected the recess of the portion 79*a* (step S201: Yes), a pulse counter of the measurement circuit is cleared (step S203) and the stepping motor 31 is operated (step S204). Then, pulses of the stepping motor 31 are counted by the pulse counter of the measurement circuit (step S205). While counting the pulses, it is checked whether the guide 33 has detected the recess of the portion 79*b* of the sensor 78*b* at the other end of the paper remote from the home position HP in the width direction (step S206). Until the guide 33 detects the recess of the portion 79*b* (step S206: No), step S205 is executed repeatedly. On the other hand, if the guide 33 has detected the recess of the portion 79*b* (step S206: Yes), the stepping motor 31 is stopped (step S207) and then the number of pulses counted by the pulse counter is converted into a paper width (step S208). This paper width is outputted to the main control section 40.

It may be arranged that the guide 33 continues to detect the recess of the portion 79*b* and, when the recess of the portion 79*b* is not detected by the guide 33, the paper width measurement is implemented assuming that a change in paper width is detected.

Figure 21:
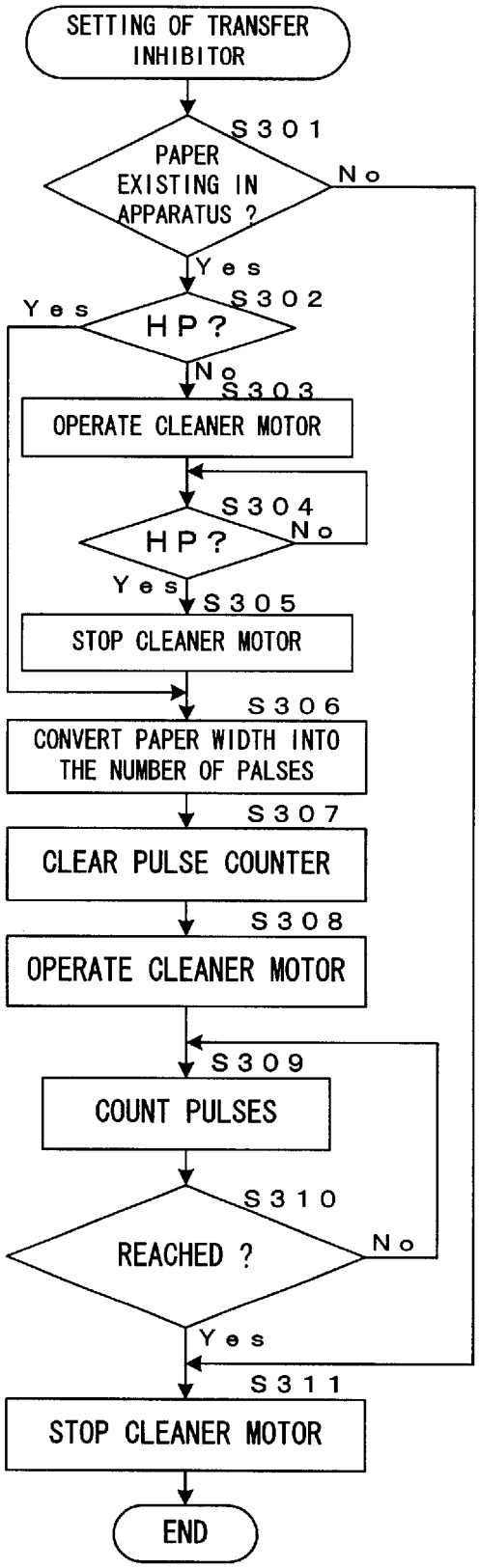
FIG. 21 is a flowchart showing details of a transfer inhibitor setting operation shown in FIG. 19.

The setting of the transfer inhibitor 5 (cleaner 52) at step S105 is carried out as shown in FIG. 21. First, it is checked whether or not paper exists in the apparatus (step S301). If there exists no paper (step S301: No), the routine is finished. On the other hand, if paper is detected (step S301: Yes), it is checked whether the transfer inhibitor 5 is located at the home position HP (step S302). If located at the home position HP (step S302: Yes), the routine proceeds to step S306. On the other hand, if not located at the home position HP (step S302: No), the motor 54 is operated to move the transfer inhibitor toward the home position HP (step S303). While moving the transfer inhibitor 5, it is checked whether or not the transfer inhibitor 5 has reached the home position HP (step S304). If it has not reached the home position HP (step S304: No), step S304 is executed again. On the other hand, if the transfer inhibitor 5 has reached the home position HP (step S304: Yes), the motor 54 is stopped (step S305). Then, the paper width obtained in the foregoing paper width measurement is converted into the number of pulses for driving the motor 54 to move the transfer inhibitor 5 (step S306). Then, a pulse counter of the main control section 40 is cleared (step S307). Then, the motor 54 is operated (step S308). Then, pulses of the motor 54 are counted by the pulse counter of the main control section 40 (step S309). While counting the pulses, it is checked whether the number of pulses counted by the pulse counter has reached the number of pulses derived at step S306 (step S310). Until the answer at step S310 becomes positive (step S310: No), step S309 is executed repeatedly. On the other hand, if the answer at step S310 becomes positive (step S310: Yes), the motor 54 is stopped (step S311).

Figure 22:
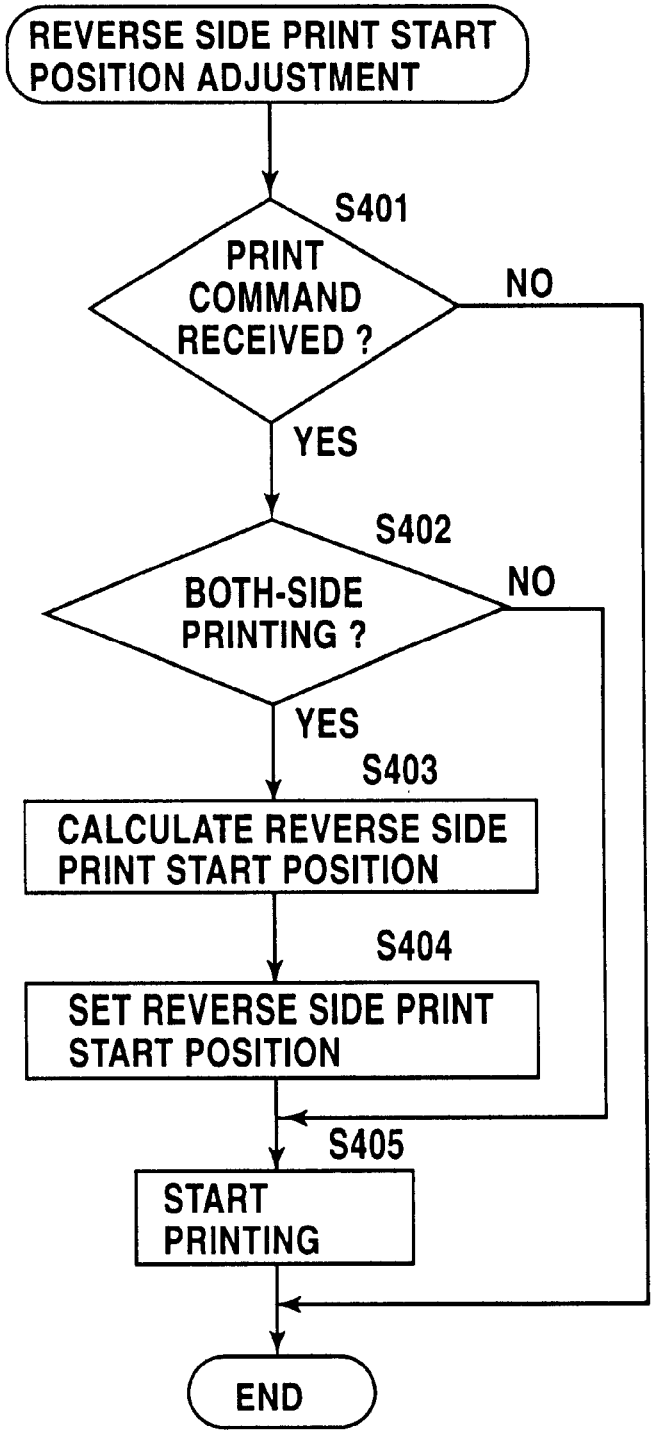
FIG. 22 is a flowchart showing details of a reverse print start position adjusting operation shown in FIG. 19.

The adjustment of the reverse side print start position at step S106 is carried out as shown in FIG. 22. First, the main control section 40 checks whether a print command is received from the host computer (step S401). If not received (step S401: No), the routine is finished. On the other hand, if the print command is received (step S401: Yes), the main control section 40 checks whether the print command is for the both-side printing (step S402). If not for the both-side printing (step S402: No), printing is directly started (step S405). On the other hand, if the print command is for the both-side printing (step S402: Yes), the main control section 40 decodes a paper width signal sent from the measurement circuit of the width detecting mechanism 3 and converts it into a shift amount set value (step S403), i.e., a print start position on the reverse side of the paper is calculated. The main control section 40 sends it to the print start position adjusting circuit 425 for setting the reverse side print start position (step S404). Then, printing is started (step S405).

As described above, when the both-side printing is performed relative to the continuous paper P, the controller 4 determines the reverse side print start position based on the measured paper width and controls the reverse side print mechanism 1 to start printing from the determined print start position. Thus, even if the paper width is changed, the reverse side print start position can be set to a predetermined position.

Further, based on the measured paper width, the controller 4 moves the cleaner 52 (transfer inhibitor 5) in the paper width direction so as to prevent image transfer onto the continuous paper P at the other end thereof remote from the home position HP. Thus, even if the paper width is changed, the cleaner 52 can be always moved to the end of the continuous paper P so as to prevent charging at the paper end including charging via the feed holes formed at the paper end, thereby to avoid deterioration of the transfer quality.

(Second Embodiment)

Figure 23:
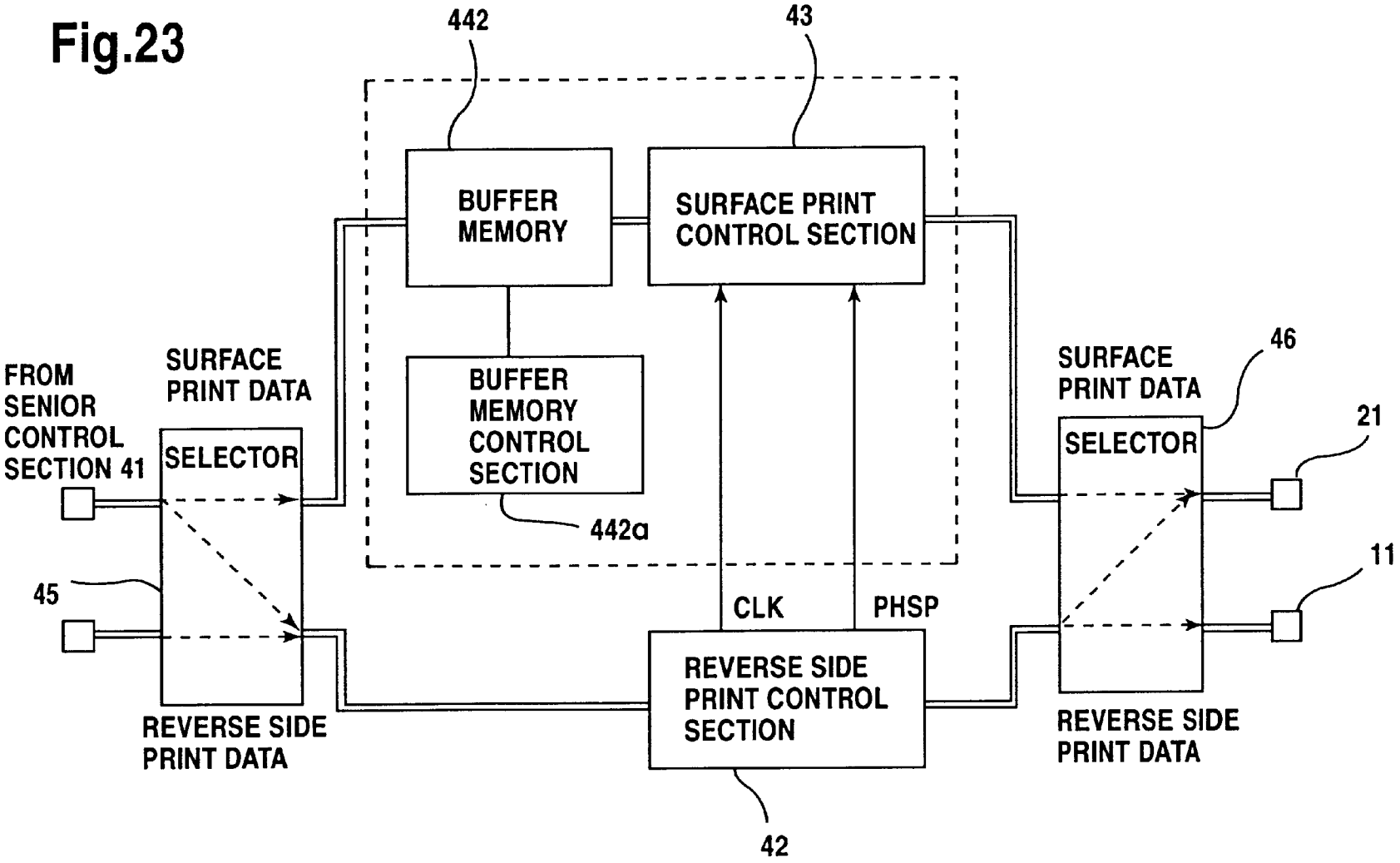
FIG. 23 is a block diagram of a controller of an image forming apparatus according to a second preferred embodiment of the present invention.

FIG. 23 is a block diagram showing a controller of an image forming apparatus according to the second preferred embodiment of the present invention. In FIG. 23, the same components as those in FIGS. 6 and 7 are assigned the same reference signs. A first selector 45 is inputted with surface print data and reverse side print data. When performing both-side printing, the first selector 45 outputs the surface print data to the surface print control section 43 and the reverse side print data to the reverse print control section 42. On the other hand, when performing one-side printing, the first selector 45 outputs the surface print data to the reverse side print control section 42.

A buffer memory control section 442*a* controls the buffer memory 442 shown in FIG. 7. When performing the both-side printing, a second selector 46 is inputted with surface print data from the surface print control section 43 and reverse side print data from the reverse print control section 42, and outputs the surface print data to the surface LED head 21 and the reverse side print data to the reverse side LED head 11. On the other hand, when performing the one-side printing, the second selector 46 is inputted with surface print data from the reverse side print control section 42 and outputs the surface print data from the reverse side print control section 42 to the surface LED head 21.

This embodiment considers a diversion of a both-side printer for printing on both sides of paper into a one-side printer for printing on only one side of paper. As described before, the surface print mechanism 2 is separated from the reverse side print mechanism 1 by the distance L so that the surface print control section 43 requires the buffer memory 442. Further, as described before, when performing the both-side printing, the main control section 40 sends the paper width signal (shift amount set value) to the print start position adjusting circuit 425 of the reverse side print control section 42 and, in response thereto, the print start position adjusting circuit 425 shifts the print data to the print start position on the reverse side of the continuous paper P corresponding to the shift amount set value. For diverting the both-side printer into a one-side printer, there should be provided one print mechanism and one print control section, i.e., the surface print mechanism 2 and the surface print control section 43.

However, in this case, there is raised a drawback that notwithstanding the one-side printer, the buffer memory 442 is necessary. Alternatively, upon diversion into a one-side printer, it is necessary to prepare a surface print control section which includes no buffer memory 442.

Therefore, in this embodiment, for using the both-side printer also as a one-side printer, the selectors 45 and 46 are provided so that the surface print data is processed in the reverse print control section 42 and then outputted to the surface LED head 21. With this arrangement, the one-side printer is realized by providing the surface print mechanism 2 and the reverse side print control section 42. Thus, the one-side printer requires no buffer memory to reduce the cost thereof. Further, the both-side printer can be used as it is for realizing the one-side printer, which can achieve further reduction in cost.

While the present invention has been described in terms of the preferred embodiments, the invention is not to be limited thereto, but can be embodied in various ways without departing from the principle of the invention as defined in the appended claims.

For example, in the foregoing preferred embodiments, the print mechanism is in the form of the electrophotography print mechanism. Instead, however, a print mechanism which realizes image formation through other exposure may also be used. Further, instead of the LED head, another exposure source, such as a liquid crystal shutter mechanism or a laser scan mechanism, may also be used.

What is claimed is:

1. An image forming apparatus comprising:

an image transfer assembly for performing image transfer onto a recording medium; and a controller which, based on a width of said recording medium, determines an image formation start position on said recording medium so as to control the image transfer onto said recording medium performed by said image transfer assembly.

2. The image forming apparatus according to claim 1, wherein said image transfer assembly comprises a pair of image transfer mechanisms provided at both sides of said recording medium, and wherein at least one of said image transfer mechanisms performs the image transfer onto said recording medium based on the image formation start position determined by said controller.

3. An image forming apparatus comprising:

an image transfer assembly for performing image transfer onto a recording medium;

a width detecting mechanism for detecting a width of said recording medium;

a transfer inhibitor for preventing the image transfer onto said recording medium; and a controller which, based on the width of the recording medium detected by said width detecting mechanism, moves said transfer inhibitor from one end to the other end of said recording medium in a width direction thereof.

4. An image forming apparatus comprising:

an image transfer assembly for performing image transfer onto a recording medium;

a home position detecting means for detecting a width detection start point of said recording medium, said home position detecting means provided at a fixed feed means for conveying one side of said recording medium;

an end detecting means for detecting one end of said recording medium remote from said width detection start point in a width direction of said recording medium, said end detecting means provided at a movable feed means which is movable in said width direction and conveys the other side of said recording medium; and a measuring means which is moved between said home position detecting means and said end detecting means so as to measure a distance therebetween, said distance corresponding to a width of said recording medium.

5. The image forming apparatus according to claim 4, wherein said measuring means is moved from said home position detecting means to said end detecting means so as to measure the distance therebetween.

6. The image forming apparatus according to claim 4, wherein said measuring means is moved to measure the width of said recording medium when a power supply to the apparatus is started.

7. The image forming apparatus according to claim 4, wherein said measuring means is moved to measure the width of said recording medium when said fixed feed means and said movable feed means are operated to automatically feed said recording medium.

8. The image forming apparatus according to claim 4, wherein said measuring means is moved to measure the width of said recording medium when a change of a recording medium width is notified.

9. The image forming apparatus according to claim 4, wherein said measuring means is moved to measure the width of said recording medium when a change of a recording medium width is detected.

10. The image forming apparatus according to claim 9, wherein said measuring means continues to detect said end detecting means, and wherein said change of the recording medium width is detected when said end detecting means is not detected by said measuring means.

11. The image forming apparatus according to claim 2, wherein the image transfer onto the recording medium performed by said pair of image transfer mechanisms at said both sides of the recording medium are in opposite directions.

* * * * *